US005894631A

United States Patent [19]

Chiu

[11] Patent Number: 5,894,631

[45] Date of Patent: Apr. 20, 1999

[54] HANDLE STRUCTURE FOR A CHEST PULL

[76] Inventor: Ciber Chiu, No. 407, Sec. 3, Luho Rd., Lukang Chen, Changhua Hsien, Taiwan

[21] Appl. No.: 09/059,643

[22] Filed: Apr. 13, 1998

[51] Int. Cl.[6] ..... A47B 95/02

[52] U.S. Cl. ..... 16/125; 16/122; 16/127; 24/136 R

[58] Field of Search ..... 16/125, 126, 127, 16/121, 122, 123, 114 B; 403/122, 76; 482/126, 121; 24/115 L, 136 R, 136 A

[56] References Cited

U.S. PATENT DOCUMENTS

| | | | |
|---|---|---|---|
| 196,324 | 10/1877 | Barnett | 16/122 |
| 1,815,863 | 7/1931 | Noe | 482/126 |
| 2,253,075 | 8/1941 | Johnson | 16/122 |
| 4,762,318 | 8/1988 | Phillips et al. | 24/115 L |
| 5,153,967 | 10/1992 | Zimmermann et al. | 16/122 |
| 5,454,140 | 10/1995 | Murai | 24/136 R |
| 5,504,977 | 4/1996 | Weppner et al. | 24/115 R |
| 5,681,248 | 10/1997 | Vani | 482/126 |

*Primary Examiner*—Chuck Y. Mah
*Attorney, Agent, or Firm*—Kolisch Hartwell Dickinson McCormack & Heuser

[57] ABSTRACT

A handle structure for a chest pull includes a substantially ring-shaped handle having a tapered passage defined radially therethrough. A positioning device including a sphere member is sized to be movably retained in the tapered passage. A shank extends from the sphere member and is connected to a collar member which has an aperture defined therethrough. A positioning member has a head movably retained in the collar member and a tail extending transversely from a mediate point of the head. The tail is positioned corresponding to the collar member so as to position a resilient member between the head and the collar member.

9 Claims, 6 Drawing Sheets

HANDLE STRUCTURE FOR A CHEST PULL

BACKGROUND OF THE INVENTION

1. Field of the Invention

The present invention relates to a handle structure for a chest pull and which includes a passage defined through a ring-shaped handle thereof, and a tube positioning device for securing the resilient tube in the passage of the handle.

2. Brief Description of the Prior Art

FIG. 8 shows a chest pull which includes two grip portions 10 and a resilient tube 11 connected between the two grip portions 10. FIG. 9 shows one of two grip portions 10 to which an end of the tube 11 is fixedly positioned. The grip portion 10 is composed of a soft fabric strip 100 and a metal ring 12 which is fixedly inserted into two overlapped ends of the strip 100 and the two ends of the strip 100 are sewed together so as to form a loop. A plastic pipe 13 is rotatably mounted to the loop so that a user may hold the pipe 13 and pull the two grip portions 10 in opposite directions. The resilient tube 11 has each one of two ends thereof inserted through the metal ring 12. A ball 14 is fixedly received in each distal end of the resilient tube 11 extending through the metal ring 12 so as to prevent the resilient tube 11 from disengaging from the metal ring 12. Therefore, the user may stretch the resilient tube 11 by pulling the two grip portions 10 apart in opposite directions. The ball 14 is fixedly received in the resilient tube 11 and is not supposed to be removed, so that an effective length, between the two balls 14, of the resilient tube 11 is fixed. This fixed length obviously cannot meet various needs of different users so that, theoretically, all the members of a family who wish to exercize each have to buy a chest pull because of the fixed effective length. Furthermore, how to fixedly receive the ball into the resilient tube 11 and ensure that the ball 14 will not escape therefrom within a short period of time is troublesome for manufacturers.

The present invention intends to provide a handle structure for a chest pull and a length between two handles can be easily adjusted so as to mitigate and/or obviate the above-mentioned problems.

SUMMARY OF THE INVENTION

The present invention provides a handle structure for a chest pull and comprising a pair of substantially ring-shaped handles each having a tapered passage defined radially therethrough, and a positioning device. The positioning device includes a sphere member which is sized to be movably retained in the tapered passage, a shank extending radially and outwardly from the sphere member and connected to a collar member which has an aperture defined therethrough, and a positioning member which has a head and a tail extending transversely from a mediate point of the head. The head is movably retained in the collar member and the tail movably and inserted into the aperture.

It is an object of the present invention to provide a handle structure for a chest pull and which allows a user to adjust a length of a resilient member between the two handles according to the user's requirement.

It is another object of the present invention to provide a handle structure for a chest pull and which has a positioning device to urge the resilient member to the handle.

It is a further object of the present invention to provide a positioning member disposed in the positioning device to position an end of the resilient member to the positioning device.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
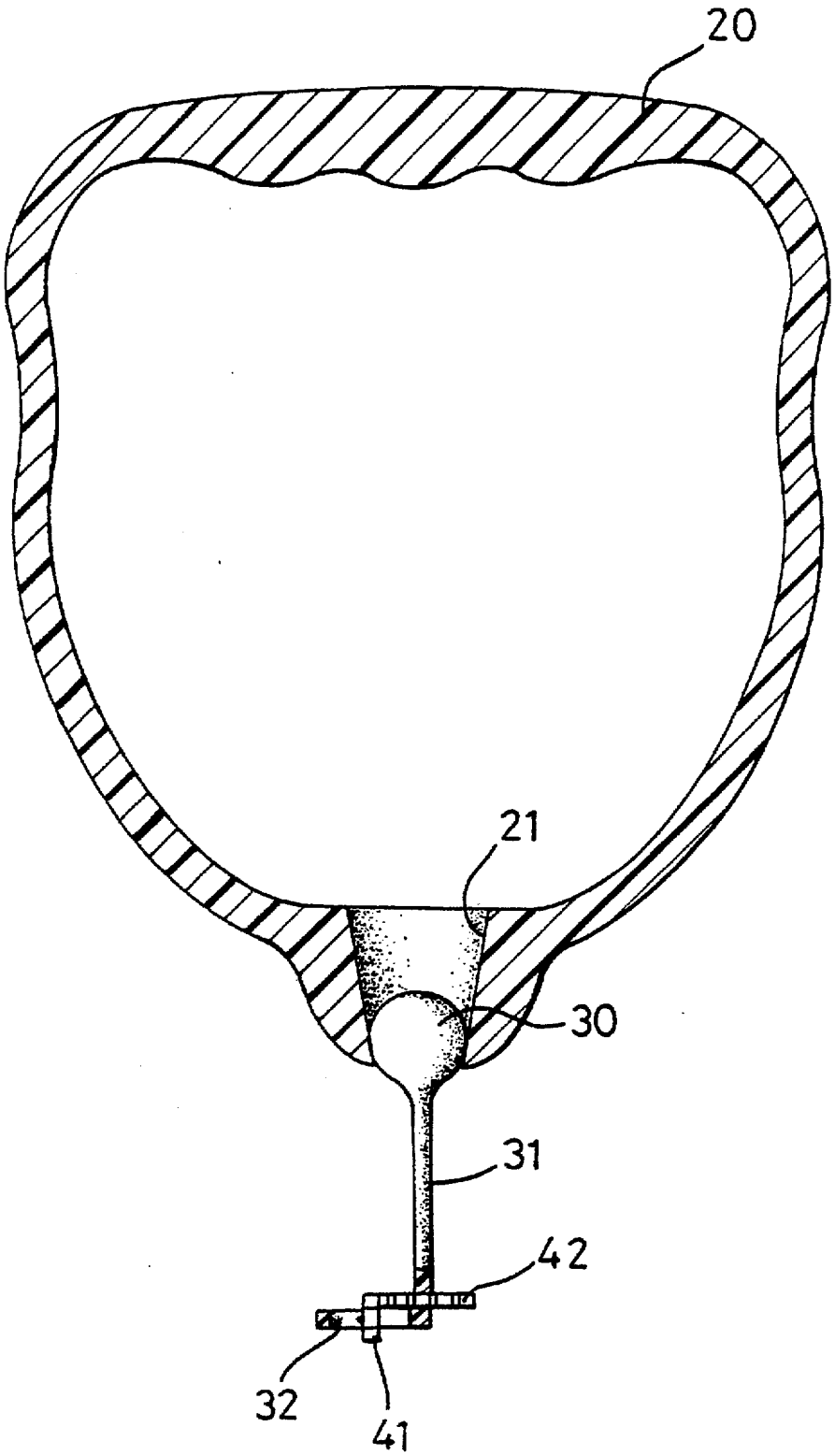
FIG. 1 is a side elevational view, partly in section, of a positioning device disposed to a handle of the present invention.
Figure 2:
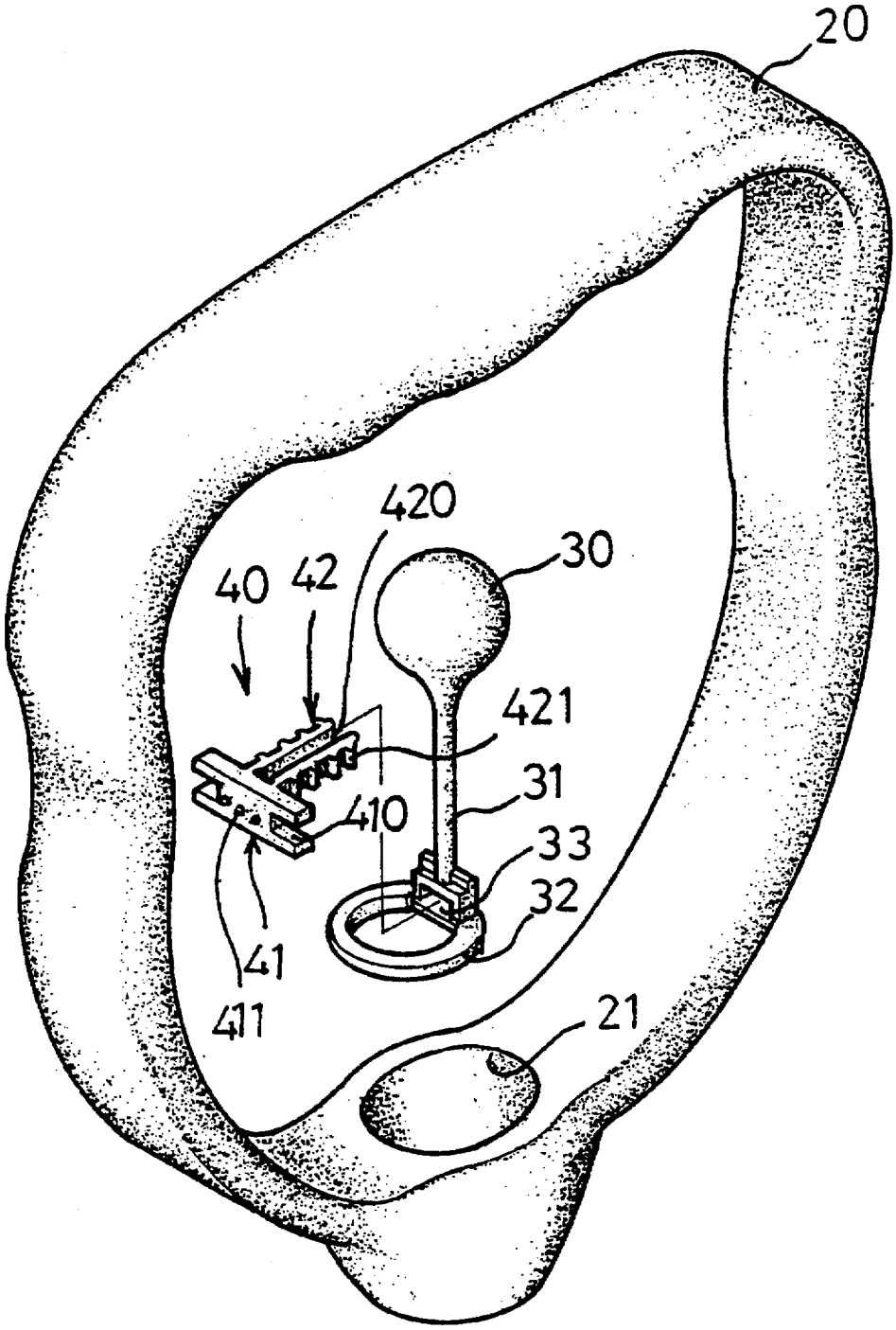
FIG. 2 is an exploded view of a positioning device and the handle in accordance with the present invention.
Figure 3:
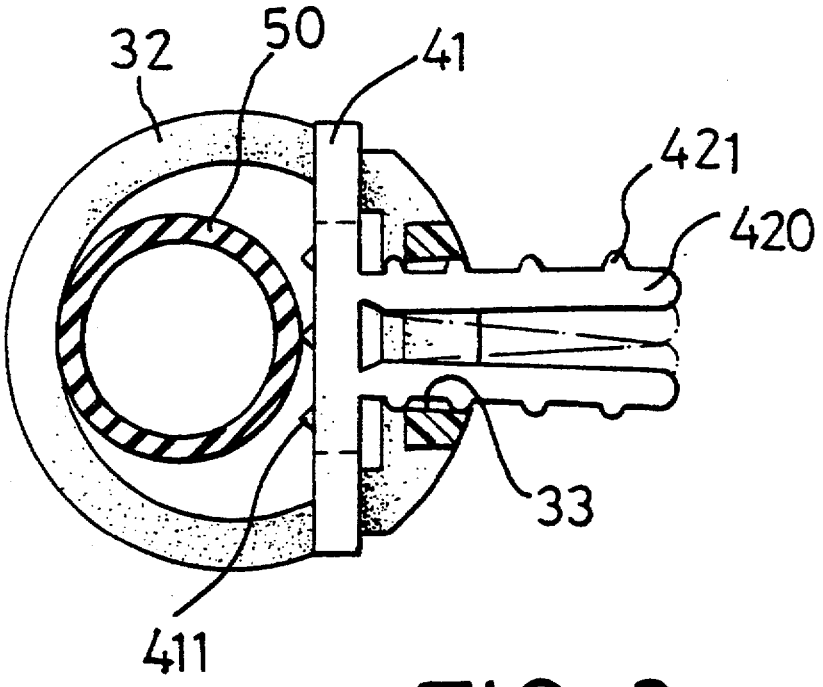
FIG. 3 is an illustrative view to show a resilient member extending through a collar member of the positioning device when a positioning member is not pushed to compress the resilient Member.

Referring to the drawings and initially to FIGS. 1 through 3, a handle structure in accordance with the present invention for a chest pull generally includes a pair of substantially ring-shaped handles 20 each having a tapered passage 21 defined radially therethrough which has an upper inner diameter and a lower inner diameter which is smaller than the upper inner diameter, and a positioning device disposed to each handle 20 in order to position a resilient member 50 (FIG. 5) in each respective tapered passage 21. It is to be appreciated that the handle structure has a pair of handles 20, as they are identical in composition, only one will be referred to hereafter. The positioning device includes a sphere member 30, a shank 31 extending radially and outwardly from the sphere member 30 and connected to a collar member 32 which has an aperture 33 defined therethrough and a diameter r larger than the lower inner diameter of the tapered passage 21. When the positioning device is fitted to the handle structure, the collar member 32 is located below the handle 20 and the sphere member 30 is received in the tapered passage 21 that the positioning device will not escape from the tapered passage 21 by an upward movement thereof. The sphere member 30 has a diameter smaller than the upper inner diameter of the tapered passage 21 and larger than the lower inner diameter of the tapered passage 21, that is to say, the sphere member 30 is sized to be movably retained in the tapered passage 21.

A positioning member 40 is disposed to the collar member 32 and has a head 41 and a tail 42 extending transversely from a mediate point of the head 41. The head 41 has two slots 410 defined in two opposite ends thereof and each of the slots 410 is sized to accommodate a thickness of the collar member 32 so that the head 41 is movably retained in the collar member 32. The head 41 further has a plurality of protrusions 411 extending from a front side thereof. The tail 42 is movably and positionably inserted into the aperture 33 and includes two arm 420 separated from each other, each of the two pieces 420 having a plurality of ribs 421 extending from an outer side thereof so as to be engaged with a periphery defining the aperture 33. Each one of two ends of the resilient member 50 is to be securely positioned in the tapered passage 21 corresponding thereto so that the resilient member 50 extends through the collar member 32 and the tapered passage 21 when assembling the chest pull.

Figure 4:
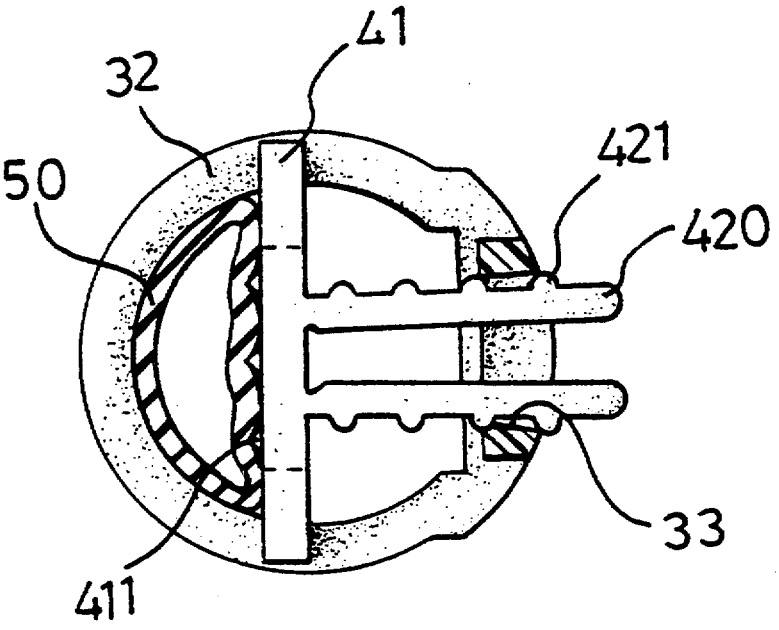
FIG. 4 is an illustrative view to show the resilient member extending through the collar member and compressed by the positioning member.
Figure 5:
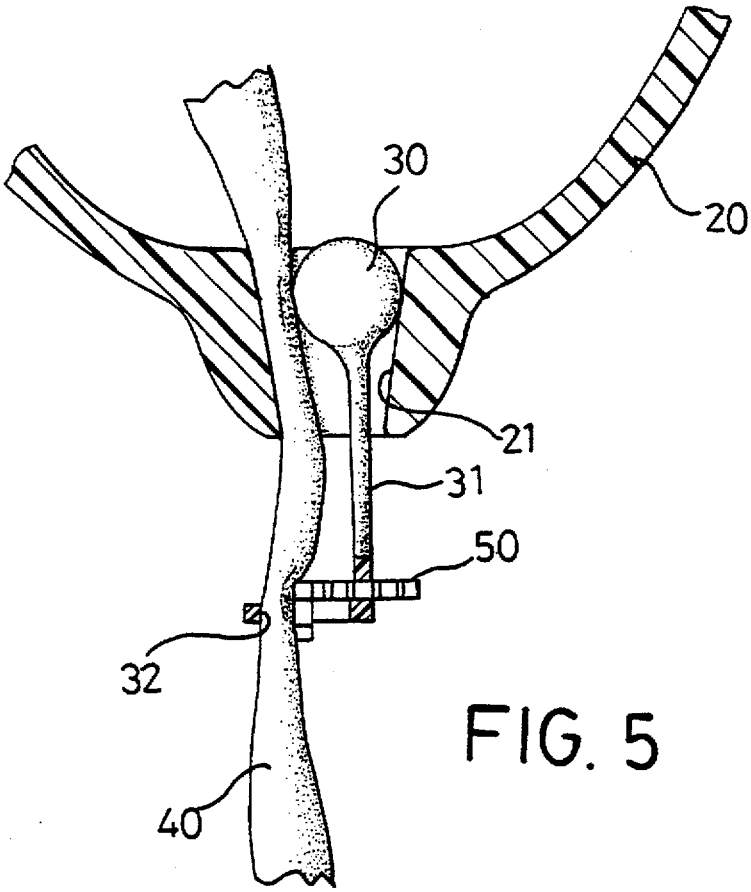
FIG. 5 is a side elevational view, partly in section, of the resilient member securely positioned to the handle by the positioning device of the present invention.

Referring to FIGS. 4 and 5, in order to prevent the resilient member 50 from dropping from the tapered passage 21 before the sphere member 30 is force-fitted in the tapered passage 21, the two arms 420 are pushed together and then the positioning member 40 is pushed toward the resilient member 50 so as to urge the resilient member 50 by the protrusions 411 between an inner periphery of the collar member 32 and the head 41 of the positioning member 40. Therefore, during adjustment of the handle 20 even if a user looses the positioning device or the resilient member 50 from his/her hand, the resilient member 50 will not drop to the ground. Accordingly, the resilient member 50 is easily and securely positioned in the tapered passage 21 by pulling the positioning device downwardly to position the resilient member 50 between the sphere member 30 and an inner periphery defining the tapered passage 21 as shown in FIG. 5. In this way a length between two handles 20 of the chest pull can be easily to be adjusted.

Figure 6:
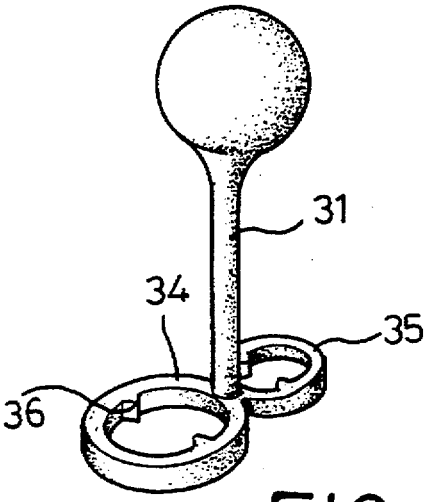
FIG. 6 is a perspective view of another embodiment of the positioning device in accordance with the present invention.
Figure 7:
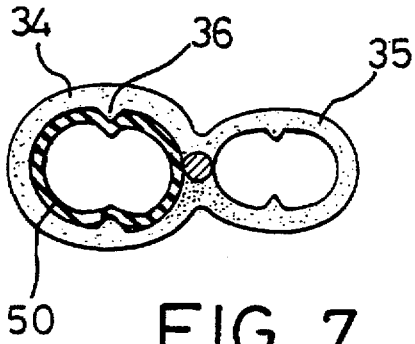
FIG. 7 is a top illustrative view to show a resilient member is retained in a collar member shown in FIG. 6.
Figure 8:
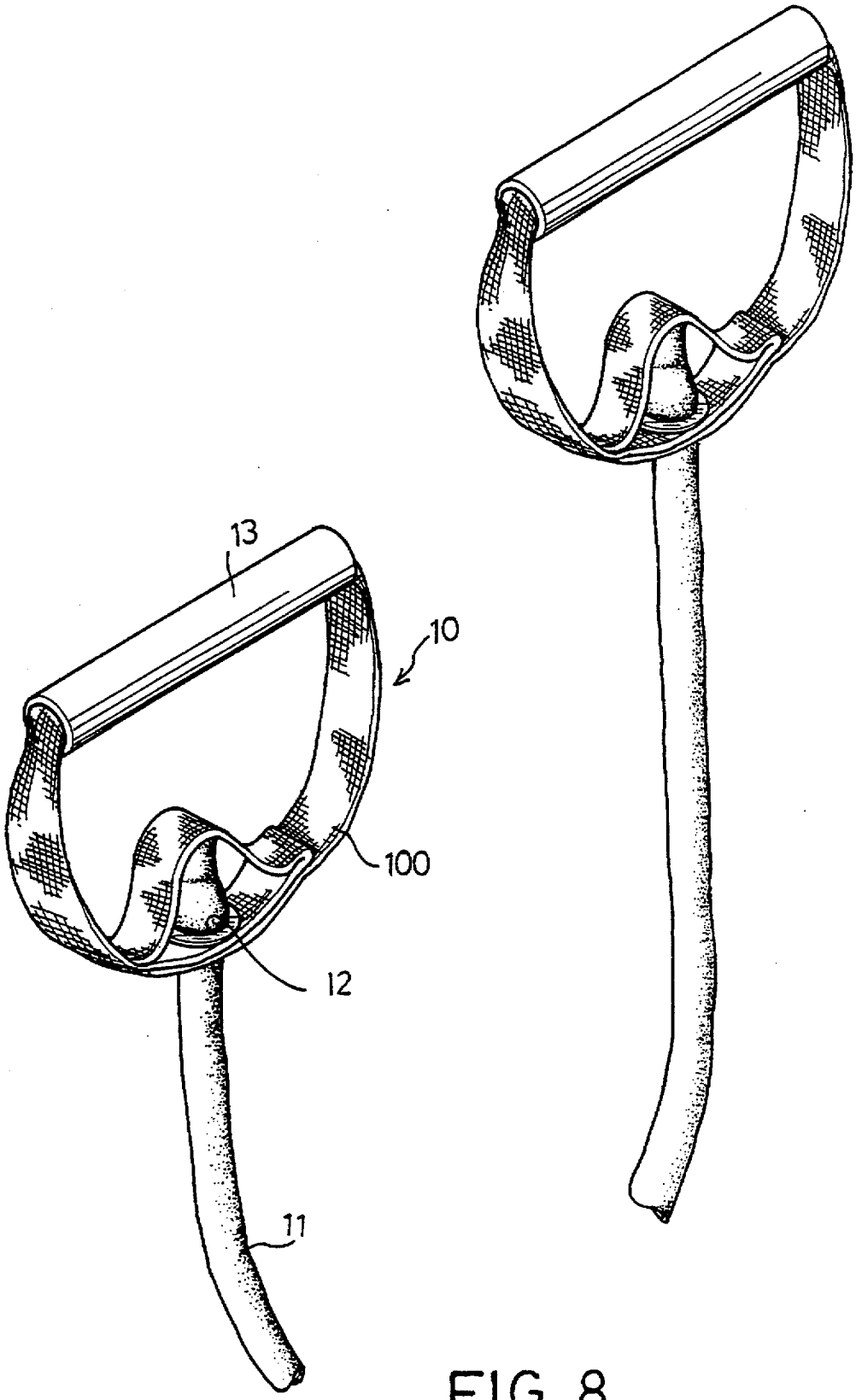
FIG. 8 PRIOR ART
FIG. 8 is a perspective view of a conventional chest pull.
Figure 9:
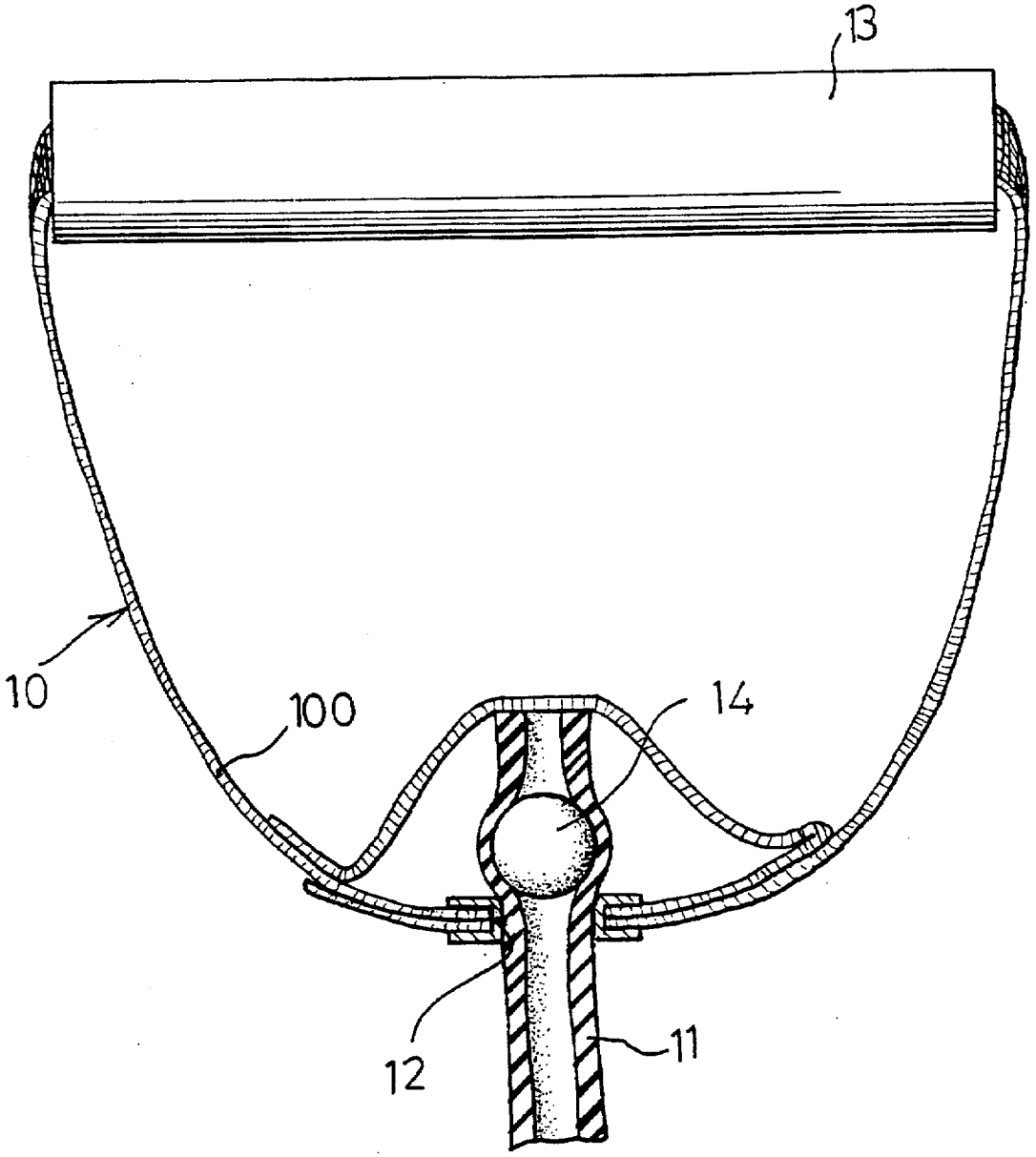
FIG. 9 PRIOR ART
FIG. 9 is a side elevational view, partly in section, of a resilient tube securely positioned to a handle of the conventional chest pull shown in FIG. 8.

FIGS. 6 and 7 show another embodiment of the positioning device of the present invention, wherein the shank 31 is connected to two collar members 34, 35 and located therebetween. Two protrusions 36 respectively extend radially and inwardly from an inner periphery defining each of the collar members 34, 35. The two collar members 34, 35 have different inner diameters so as to respectively accommodate resilient members 50 of various specifications. That is to say, the resilient member 50 is deformed by the two protrusions 36 so as to be positioned a respective one of in the collar members 34, 35.

Although the invention has been explained in relation to its preferred embodiment, it is to be understood that many other possible modifications and variations can be made without departing from the spirit and scope of the invention as hereinafter claimed.

What is claimed is:

1. A handle structure for a chest pull, comprising:

a substantially ring-shaped handle having a tapered passage defined radially therethrough, and a positioning device including a sphere member which is sized to be movably retained in said tapered passage, a shank extending radially and outwardly from said sphere member and connected to a collar member which has an aperture defined therethrough, and a positioning member having a head and a tail extending transversely from a mediate point of said head, said head being movably retained in said collar member and said tail being movably and positionably inserted into said aperture.

2. The handle structure as claimed in claim 1 wherein said tapered passage has an upper inner diameter and a lower inner diameter which is smaller than said upper inner diameter, said sphere member having a diameter smaller than said upper inner diameter of said tapered passage and larger than said lower inner diameter of said tapered passage.

3. The handle structure as claimed in claim 2 wherein said collar member has a diameter larger than said lower inner diameter of said tapered passage.

4. The handle structure as claimed in claim 1 wherein said head has two slots defined in two opposite ends thereof and each of said slots is sized to accommodate a thickness of said collar member.

5. The handle structure as claimed in claim 1 wherein said head has a plurality of protrusions extending from a front side thereof.

6. The handle structure as claimed in claim 1 wherein said tail includes two pieces separated from each other and each of said two pieces has a plurality of ribs extending from an outer side thereof so as to be engaged with a periphery defining said aperture.

7. A handle structure for a chest pull, comprising:

a substantially ring-shaped handle having a tapered passage defined radially therethrough, and a positioning device including a sphere member which is sized to be movably retained in said tapered passage, and a shank extending radially and outwardly from said sphere member and connected to at least one collar member which has at least one protrusion extending radially and inwardly from an inner periphery defining said collar member.

8. The handle structure as claimed in claim 7 wherein said tapered passage has an upper inner diameter and a lower inner diameter which is smaller than said upper inner diameter, said sphere member having a diameter smaller than said upper inner diameter of said tapered passage and larger than said lower inner diameter of said tapered passage.

9. The handle structure as claimed in claim 8 wherein said collar member has a diameter larger than said lower inner diameter of said tapered passage.

* * * * *